United States Patent [19]
Pitler
[11] 4,315,776
[45] Feb. 16, 1982

[54] METHOD OF PRODUCING LIGHT GAGE METALLIC STRIP MATERIAL

[75] Inventor: Richard K. Pitler, Gibsonia, Pa.

[73] Assignee: Allegheny Ludlum Steel Corporation, Pittsburgh, Pa.

[21] Appl. No.: 69,010

[22] Filed: Aug. 23, 1979

[51] Int. Cl.³ ..... B22F 3/14; B22F 3/16; B22F 3/24; B22F 5/00

[52] U.S. Cl. ..... 75/208 R; 75/200; 75/226; 29/18; 428/606

[58] Field of Search ..... 75/226, 208 CS, 200; 428/606; 29/18, 420.5; 72/324

[56] References Cited

U.S. PATENT DOCUMENTS

| | | | |
|---|---|---|---|
| 1,701,889 | 2/1929 | Junker | 29/18 |
| 3,262,182 | 7/1966 | Duret et al. | 29/18 |
| 3,355,971 | 12/1967 | Vigor | 29/18 X |
| 3,460,366 | 8/1969 | Musial et al. | 29/18 X |
| 3,710,474 | 1/1973 | Kelly et al. | 428/606 X |
| 3,803,702 | 4/1974 | Bratt et al. | 75/226 X |
| 4,070,739 | 1/1978 | Hague et al. | 29/18 |
| 4,075,747 | 2/1978 | Hague et al. | 29/18 |
| 4,085,496 | 4/1978 | Malkani et al. | 29/18 |

*Primary Examiner*—Brooks H. Hunt
*Assistant Examiner*—J. J. Zimmerman
*Attorney, Agent, or Firm*—Patrick J. Viccaro

[57] ABSTRACT

An improved method of producing a coil of light gage metallic strip material is disclosed comprising the steps of compressing a metal powder mixture into a cylindrical billet having homogeneous structure, grain size and chemical composition, rotating the billet about its longitudinal axis, and peeling a continuous light gage layer from the exterior surface of the rotating billet by advancing a cutting edge of a cutting tool into subsurface contact with the rotating billet along the full longitudinal extent of the billet.

12 Claims, No Drawings

METHOD OF PRODUCING LIGHT GAGE METALLIC STRIP MATERIAL

BRIEF SUMMARY OF THE INVENTION

The present invention relates to an improved method of peeling metal strip, and more particularly is directed to a method of producing coils of light gage strip material by peeling a continuous light gage layer from the exterior surface of a rotating billet of compressed powder metal.

Rotary cutting, or peeling, is well known in the art. For example, nearly all of the veneer presently produced in the United States is manufactured by revolving a cylindrical wooden bolt against a knife to produce a thin wooden sheet of any desired width. This process has also been applied to the production of metallic strip material. The prior art, such as U.S. Pat. Nos. 3,262,182, 3,355,971, and 3,460,366 disclose various metal strip peeling processes. Metallic strip production by peeling is considered to be cost advantageous over metal strip production by rolling or casting. The capital equipment requirements, power and temperature requirements and operating requirements associated with progressive reduction of metal ingots to light gage strip material far exceed the requirements associated with the peeling of strip material. Furthermore, the conventional manufacture (rolling) of certain alloys in the form of light gage strip, such as stainless steel foil, requires special attention because such materials are sensitive to thermal stress in large sizes, are highly resistant to deformation during hot or cold rolling, and are subject to embrittlement during cooling from necessary heat treatment or annealing temperatures. Also, the casting, as opposed to rolling, of such light gage materials may cause the material to develop brittle phases. Therefore, in certain applications, the peeling of metallic strip material may provide a unique advantage over the more conventional rolling or casting operations.

The prior art pertaining to metal peeling processes, such as that mentioned above, teaches the necessity of taking certain precautions in the peeling operation. For example, elaborate cooling apparatus may have to be provided to minimize adverse effects that may be experienced from the significant heat generated during peeling. Also, tension devices may be required to insure smooth surface characteristics in the peeled strip. Furthermore, the peeling apparatus must not experience deflections and must be rigidly constructed and operated in order to successfully produce peeled metallic strip material.

Accordingly, a new and improved process for producing coils of peeled metallic strip material is desired which may be more efficient and more effective than that disclosed in the prior art, and may not require the elaborate precautions which the prior art indicates may be necessary to successfully peel coils of metallic strip material.

The present invention may be summarized as providing an improved method of producing a coil of light gage metallic strip material comprising the steps of compressing a metal powder mixture into a cylindrical billet having homogeneous structure, grain size and chemical composition, rotating the billet about its longitudinal axis, and peeling a continuous light gage layer from the exterior surface of the rotating billet by advancing a cutting edge of a cutting tool into subsurface contact with the rotating billet along the full longitudinal extent of the billet.

Among the advantages of the present invention is the provision of a new and improved method of producing coils of peeled metallic strip material which includes the initial step of forming a peelable cylindrical billet from metallic powder to provide a material which is more easily and uniformly peeled as compared to conventional cast, remelted or forged cylindrical billets of the prior art.

An objective of the present invention is to provide a process which is more flexible than peeling processes which utilize conventional cast, remelted or forged cylindrical billets. For example, the process of the present invention permits peeling of a wider range of chemical compositions. In particular, certain chemical compositions which are not readily amenable to production by casting and remelt techniques may be easily formed by powder metallurgical techniques into a billet which may be peeled. Also, the present invention is more flexible because powder metallurgically formed billets may be peeled to a wider range of gages than conventionally formed billets of the prior art.

Another advantage of the method of the present development is that less heat is generated in peeling a powder metallurgically formed billet which may significantly reduce the coolant requirements in the peeling operation.

A further advantage of the present invention is the provision of a method of producing a coil of light gage metallic strip material which results in a significant reduction in the amount of scrapped material as compared to prior art processes.

A further objective of the present invention is to provide a method of producing a coil of peeled metallic strip material which requires less cutting force and therefore results in higher production rates, increased tool life and less overall power requirements as compared to metallic strip peeling processes of the prior art.

These and other objectives and advantages may be more fully understood and appreciated with reference to the following detailed description.

DETAILED DESCRIPTION

The present invention is directed to a process for producing a coil of light gage metallic strip material. In accordance with the present invention, light gage strip material includes strip having a gage of 0.015 inch or less. Such strip material may be utilized in a variety of applications, including substrates for catalytic converters. In order to successfully compete with conventional rolled or cast strip materials, a peeled strip material must be of a substantially uniform chemical composition, exhibit uniform gage throughout the strip length, and exhibit a substantially smooth surface texture in the peeled strip.

In the process of the present invention, a metallic powder mixture is first compressed into a cylindrical billet. Such powder metallurgically formed billet may be compressed by a variety of methods including hot isostatic pressing, cold compaction and powder extrusion. It will be understood by those skilled in the art that the billet may be sintered after compression. Regardless of the compressing operation utilized, the powder metallurgically formed billet exhibits homogeneous structure, grain size and chemical composition. As will be explained in more detail below, the step of first compressing a powder mixture into a cylindrical billet provides a material which can be more readily peeled into a coil of light gage strip material.

Metal powders which may be compressed into cylindrical billets by the process of the present invention include a variety of metals. Metals finding particular application in the process of this invention include a variety of high temperature alloys including a variety of steel alloys, such as stainless steel alloy powder. High temperature alloys of the present invention are defined herein to include a variety of alloys which may be used in corrosive or high temperature environments. Such metal alloys include tungsten, titanium and molybdenum powders as well as any metal powder which is capable of compaction into cylindrical billets for peeling. Specific alloys comprehended by the present invention include fecralloy, Waspaloy, Udimet 700, Hastelloy C, AL 6X and Inco 625.

In the process of the present invention a powder metallurgical billet is formed in a generally cylindrical configuration. Preferably, the length of such cylinder corresponds substantially with the width of the material to be peeled therefrom. However, it will be understood, that in alternative embodiments a plurality of strips may be simultaneously or successively peeled from one billet. The end portions of the cylindrical billet are preferably formed for mounting into a rotary mechanism. With powder metallurgical compaction, a billet may be more readily formed to final dimensions without requiring additional, or subsequent, machining, threading or trimming operations which may otherwise be required to adapt a cast or forged billet for mounting into a rotary mechanism.

In a preferred embodiment of the present invention cylindrical mandrel of low cost material such as carbon or alloy steel may be first inserted into a low cost metallic container, or can, which is then filled with the powder metal to be compacted. The powder may be vibrated to obtain a loose density of at least about 60%. Within the can the powder is then compressed around the mandrel. Preferably, the powder is compressed to a density in excess of 85% of theoretical full density of 100%. It will be appreciated that a central mandrel and peripheral can could not be readily formed as an integral part of a cast billet of the prior art because the mandrel and can would tend to melt and decompose or contaminate the molten metal if exposed to the excessive molten metal temperatures during casting. Further, it will be apparent that compacted powders in such preferred embodiment are integrally compressed into intimate contact with the can and the centrally located mandrel.

The preferred compression of the cylindrical powder metallurgical billet includes the advantage of providing a mandrel which may serve as a mounting for the billet. With such mandrel a billet may be inserted into a peeling machine without the necessity of providing auxiliary clamping or mounting arrangements.

Further, such preferred powder metallurgical cylinder results in a significant decrease in the amount of expensive peeling material that would otherwise be lost or scrapped in the peeling operation. The initiation of peeling often is unstable and often a number of rotations of the billet must be accomplished before the peeling operation has become stable. With the preferred cylinder of this invention, as described above, peeling begins on the low cost can. The surface of the can is peeled initially. Thus, the steps necessary to stabilize the peeling operation are performed on the low cost container, and, by the time the peeling operation is efficiently and effectively operating on the powder metal cylinder, the expensive material is being peeled with a minimum of lost or scrapped product, if any. It is understandable that if such a container is placed around a conventionally cast billet, such container would not be integrally bonded to the cast billet as is the powder metallurgically formed billet of the present invention, and may tend to dislodge completely from the cast billet during the forceful peeling operation.

The preferred compression of the cylindrical powder metallurgical billet of the present invention, i.e., around a centrally positioned mandrel, also results in a decrease in the amount of material that is lost or scrapped at the end of the peeling operation. It is understandable that in instances where no central mandrel is provided, such as in conventional cast billets, the peeling operation can only be performed until the billet is reduced to a diameter which becomes too small to rigidly support the peeling process. Under such circumstances the entire core which may comprise as much as half of the billet, by weight, may have to be discarded. With the preferred, central mandrel of low cost material, around which the powder is compressed, no such loss is experienced. The peeling of such a preferred billet may proceed down to the mandrel itself with virtually no loss of expensive powder metal material.

The peeled light gage strip material of the present invention is preferably wound into a coil as it is peeled. It should also be understood that the peeled strip material could be slit, cut, stacked, coated, or the like, immediately after peeling.

In accordance with the present invention, three different types of cylinders were manufactured for testing in a peeling operation. All three cylinders consisted of a stainless steel alloy containing 16% chromium, 5% aluminum, 0.3% yttrium and the balance being iron. All three cylinders had a 4 inch outside diameter and a thickness, or longitudinal extent, of ¼ inch. The cylinders differed in their method of manufacture. The first cylinder, in the wrought condition, was poured from a 50 pound vacuum induction heat. The material was hot rolled at a temperature of about 2300° F. to a ¼ inch thickness and annealed for 5 minutes at a temperature of 1800° F. and air cooled. The second cylinder, in the cast condition, was poured from a 50 pound laboratory heat. The molten metal from such heat was cast into a 4¾ inch inside diameter pipe mold set in sand and preheated to about 700° F. After the ingot was slow cooled, ¼ inch cylinders were machined from the as-cast ingot. The third cylinder was produced by hot isostatically pressing the stainless steel powder at a temperature of 1900° F. and a pressure of 15 ksi for 3 hours. Metallurgical examination confirmed a fine uniform structure in the powder metallurgical formed cylinder.

Attempts were made to peel each cylinder at both 0.002 and 0.005 inch thickness. The cylinder in the wrought condition was found to peel satisfactorily but produced a barely acceptable product characterized by a rough surface and poor flatness. Peeling of the cast cylinder produced an unsuitably brittle product containing cracks and holes. Excellent quality light gage strip material was produced from the powder metallurgy cylinder. Such tests were conducted without an automatic tension mechanism illustrating the ease with which powder metallurgically compressed billets may be peeled as compared to cast or wrought cylinders of the prior art.

What is believed to be the best mode of this invention has been described above. It will be apparent to those skilled in the art that numerous variations of the illustrated details may be made without departing from this invention.

What is claimed is:

1. An improved method of producing a coil of light gage metallic strip material comprising the steps of:

disposing a metal powder mixture around the periphery of a cylindrical mandrel centrally disposed, said mandrel having its end portions adapted for mounting onto a rotating mechanism, compressing the powder mixture of said metal into a cylindrical billet having homogenous structure, grain size and chemical composition, said billet being integrally compressed into engagement with the mandrel to form a composite cylindrical article, rotating the cylindrical article about its longitudinal axis by the rotating mechanism, peeling a continuous light gage layer from the exterior surface of the rotating article by advancing a cutting edge of a cutting tool into subsurface contact with the rotating article along the full logitudinal extent of the article, and continuing peeling until an integral layer of strip material is peeled from the mandrel.

2. A method as set forth in claim 1 wherein the light gage metallic strip material has a thickness of less than 0.015 inch.

3. A method as set forth in claim 1 wherein the light gage metallic strip material has a thickness of from 0.001 to 0.010 inch.

4. A method as set forth in claim 1 wherein the light gage metallic strip material has a thickness of from 0.002 to 0.005 inch.

5. A method as set forth in claim 1 wherein the powder mixture is compressed by hot isostatic compacting.

6. A method as set forth in claim 1 wherein the powder mixture is compressed by cold compaction and the cold compressed billet is sintered prior to peeling.

7. A method as set forth in claim 1 wherein the powder mixture is compressed by powder extrusion.

8. A method as set forth in claim 1 wherein the metal is a high temperature alloy.

9. A method as set forth in claim 8 wherein the high temperature alloy is stainless steel.

10. A method as set forth in claim 1 further including the step of winding the peeled light gage layer into a coil.

11. An improved method of producing a coil of light gage metallic strip material comprising the steps of:

disposing a powder mixture of high temperature alloy into a cylindrical carbon steel container and around the periphery of a cylindrical carbon steel mandrel centrally disposed inside the container with respect to the longitudinal axis of the container, said mandrel having its end portions adapted for mounting onto a rotating mechanism, compressing the powder mixture in the container about the mandrel into at least an 85% dense compact cylindrical billet having homogeneous structure, grain size and chemical composition, said billet being integrally compressed into engagement with the mandrel and the container to form a composite cylindrical article, mounting the end portions of the mandrel in the composite article onto a rotating mechanism, rotating the cylindrical article about its longitudinal axis by engaging the rotating mechanism, peeling a continuous light gage layer from the exterior surface of the rotating article by advancing a cutting edge of a cutting tool into subsurface contact with the exterior surface of the rotating article along the full longitudinal extent of the exterior surface of the rotating article, whereby the container is removed as an initially peeled layer, and continuing peeling until an integral layer of carbon steel is peeled from the mandrel.

12. A method as set forth in claim 11 further including the step of winding the light gage layer into a coil while peeling.

* * * * *